US009316932B2

(12) United States Patent
Nonaka et al.

(10) Patent No.: US 9,316,932 B2
(45) Date of Patent: Apr. 19, 2016

(54) ELECTROPHOTOGRAPHIC PHOTOSENSITIVE MEMBER, METHOD FOR PRODUCING ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Masaki Nonaka, Toride (JP); Hideaki Nagasaka, Suntou-gun (JP); Masato Tanaka, Tagata-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 12 days.

(21) Appl. No.: 14/082,642

(22) Filed: Nov. 18, 2013

(65) Prior Publication Data

US 2014/0141363 A1 May 22, 2014

(30) Foreign Application Priority Data

Nov. 19, 2012 (JP) ..... 2012-253459
Oct. 28, 2013 (JP) ..... 2013-222955

(51) Int. Cl.

| | |
|---|---|
| ***G03G 5/14*** | (2006.01) |
| ***G03G 5/06*** | (2006.01) |
| ***G03G 5/07*** | (2006.01) |
| ***G03G 5/147*** | (2006.01) |
| ***G03G 21/18*** | (2006.01) |

(52) U.S. Cl.

CPC ..... *G03G 5/0618* (2013.01); *G03G 5/0614* (2013.01); *G03G 5/0616* (2013.01); *G03G 5/0666* (2013.01); *G03G 5/0668* (2013.01); *G03G 5/0672* (2013.01); *G03G 5/071* (2013.01); *G03G 5/076* (2013.01); *G03G 5/1473* (2013.01); *G03G 5/14708* (2013.01); *G03G 5/14717* (2013.01); *G03G 5/14734* (2013.01); *G03G 21/18* (2013.01)

(58) Field of Classification Search

USPC ..... 430/66, 58.7

See application file for complete search history.

(56) References Cited

U.S. PATENT DOCUMENTS

| | | | |
|---|---|---|---|
| 4,599,288 | A | 7/1986 | Fuchizawa |
| 4,657,835 | A | 4/1987 | Yashiki |
| 5,374,494 | A | 12/1994 | Kashimura et al. |
| 5,811,212 | A | 9/1998 | Tanaka |
| 8,962,227 | B2 | 2/2015 | Tanaka et al. |

(Continued)

FOREIGN PATENT DOCUMENTS

| | | | |
|---|---|---|---|
| EP | 2278407 | A1 | 1/2011 |
| JP | 03-246551 | A | 11/1991 |

(Continued)

OTHER PUBLICATIONS

U.S. Appl. No. 14/082,680, filed Nov. 18, 2013, Masaki Nonaka.

(Continued)

*Primary Examiner* — Peter Vajda

(74) *Attorney, Agent, or Firm* — Canon USA Inc. IP Division

(57) ABSTRACT

An electrophotographic photosensitive member includes a support and a photosensitive layer formed on the support. A surface layer of the electrophotographic photosensitive member contains a polymerized product of a composition that contains a charge transporting compound having a particular group (chain polymerizable functional group).

12 Claims, 2 Drawing Sheets

(56) References Cited

U.S. PATENT DOCUMENTS

| | | | | |
|---|---|---|---|---|
| 2005/0196196 | A1* | 9/2005 | Ota et al. | 399/159 |
| 2012/0301177 | A1* | 11/2012 | Tanaka et al. | 399/111 |
| 2014/0141364 | A1* | 5/2014 | Nonaka et al. | 430/56 |

FOREIGN PATENT DOCUMENTS

| | | | |
|---|---|---|---|
| JP | 04-84180 | A | 3/1992 |
| JP | 2000066425 | A | 3/2000 |
| JP | 2000147815 | A | 5/2000 |
| JP | 2005049579 | A | 2/2005 |
| JP | 2005062300 | A | 3/2005 |
| JP | 2010152180 | A | 7/2010 |
| JP | 2010156835 | A | 7/2010 |
| WO | WO 97/33193 | * | 9/1997 |
| WO | WO 97/33193 | A2 | 9/1997 |

OTHER PUBLICATIONS

Weiss, David S., "Surface Injection in Corona-Charged Molecularly Doped Polymer Films", JOurnal of Imaging Science, Jul./Aug. 1990, pp. 132-135, vol. 34, No. 4.

Diamond, A.S., ed., Handbook of Imaging Materials, Marcel Dekker, Inc., NY (1991 ), pp. 395-396.

* cited by examiner

ELECTROPHOTOGRAPHIC PHOTOSENSITIVE MEMBER, METHOD FOR PRODUCING ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

1. Field of the Invention

The present invention relates to an electrophotographic photosensitive member, a method for producing an electrophotographic photosensitive member, a process cartridge, and an electrophotographic apparatus.

2. Description of the Related Art

An electrophotographic photosensitive member repeatedly used in an electrophotographic apparatus desirably has high wear resistance. Japanese Patent Laid-Open No. 2000-066425 describes a technique of improving the wear resistance of an electrophotographic photosensitive member. According to this technique, a polymerized product obtained through polymerization of a charge transporting compound having a chain polymerizable functional group is added to a surface layer of the electrophotographic photosensitive member. Japanese Patent Laid-Open No. 2000-066425 teaches that an acryloyloxy group and a methacryloyloxy group are particularly favored as the chain polymerizable functional group.

As the wear resistance of the electrophotographic photosensitive member is improved, it becomes more difficult to refresh the surface of the electrophotographic photosensitive member. The material that has undergone chemical changes by repetitive use tends to remain on the surface of the electrophotographic photosensitive member. Discharge products generated through a charging process that involves discharging are thought to be the main cause of the chemical changes of the materials constituting the surface of the electrophotographic photosensitive member. In particular, when one of the materials constituting the surface of the electrophotographic photosensitive member is a charge transporting compound (also refers to a polymerized product of a charge transporting compound, the same applies hereinafter), the charge transporting compound serves as a donor and NOx, which is a type of discharge products, serves as an acceptor, thereby readily generating DA ion pairs. Since DA ion pairs absorb light in the visible light region, the presence of the DA ion pairs is identifiable by visual observation or through visible absorption spectrum measurement. The DA ion pairs eventually form covalent bonds and the charge transporting compound (charge transporting structure) is thereby modified into a NOx-modified compound (refer to D. S. Weiss, J. Imag. Sci., 34, 132 (1990)).

Once the charge transporting compound (charge transporting structure) becomes modified, various properties of the photosensitive member are induced. For example, the modified part of the charge transporting compound (charge transporting structure) acts as a charge trap and may result in an increase in residual potential.

SUMMARY OF THE INVENTION

The present invention provides an electrophotographic photosensitive member which contains a polymerized product of a composition that contains a charge transporting compound having a polymerizable functional group and in which the charge transporting compound is not easily modified despite the repetitive use and image defects caused by modification are suppressed. A method for producing the electrophotographic photosensitive member is also provided.

The present invention also provides a process cartridge and an electrophotographic apparatus that include the electrophotographic photosensitive member.

The present invention provides an electrophotographic photosensitive member comprising a support and a photosensitive layer formed on the support. A surface layer of the electrophotographic photosensitive member comprises a polymerized product of a composition comprising a charge transporting compound with a polymerizable functional group represented by formula (1) below:

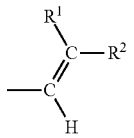

(1)

where $R^1$ and $R^2$ each independently represent a hydrogen atom or a straight alkyl group and at least one of $R^1$ and $R^2$ is the straight alkyl group.

The present invention also provides a method for producing the electrophotographic photosensitive member described above. The method comprises forming a coat by using a surface layer-forming coating solution comprising a composition comprising the charge transporting compound and forming a surface layer by polymerizing the composition contained in the coat.

The present invention also provides a process cartridge detachably attachable to a main body of an electrophotographic apparatus, wherein the process cartridge integrally supports the electrophotographic photosensitive member described above, and at least one unit selected from the group consisting of a charging unit, a development unit, a transfer unit, and a cleaning unit.

The present invention also provides an electrophotographic apparatus comprising the electrophotographic photosensitive member described above, a charging unit, an exposure unit, a development unit, and a transfer unit.

Further features of the present invention will become apparent from the following description of exemplary embodiments with reference to the attached drawings.

DESCRIPTION OF THE EMBODIMENTS

Figure 1A:
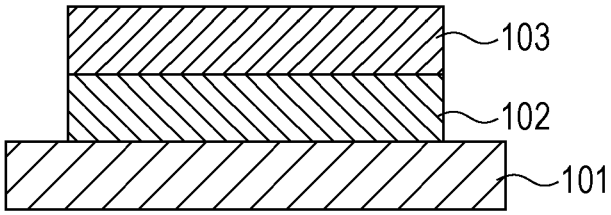
FIG. 1A and FIG. 1B are diagrams showing examples of the layer configuration of an electrophotographic photosensitive member.

An electrophotographic photosensitive member according to an embodiment of the present invention is an electrophotographic photosensitive member that includes a support and a photosensitive layer formed on the support. A surface layer of the electrophotographic photosensitive member contains a polymerized product of a composition that contains a charge transporting compound with a polymerizable functional group represented by formula (1) below:

(1)

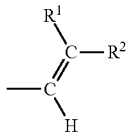

In formula (1), $R^1$ and $R^2$ each independently represent a hydrogen atom or a straight alkyl group and at least one of $R^1$ and $R^2$ is the straight alkyl group.

As discussed above, the electrophotographic photosensitive member suppresses image defects induced by modification of the charge transporting compound (charge transporting structure) despite the repetitive use. The inventors assume the reason for this as follows.

The charge transporting compound that has an acryloyloxy group or a methacryloyloxy group as disclosed in Japanese Patent Laid-Open No. 2000-066425 generates large amounts of radicals during polymerization reaction and a polymerized product is generated at a high polymerization efficiency due to rapid polymerization reaction between unsaturated double bond portions (C═C).

The inventors have conducted studies and found that the charge transporting compound that has an acryloyloxy group or a methacryloyloxy group is likely to undergo rapid polymerization reaction while the charge transporting structure remains twisted and that a dense polymerized product is difficult to obtain. Moreover, the charge transporting compound having a cinnamoyloxy group described in Japanese Patent Laid-Open No. 2000-066425 has a phenyl group which is located near an unsaturated double bond portion and causes a significant steric hindrance. Thus, radicals tend to be deactivated before polymerization reactions take place and thus it tends to be difficult to obtain dense polymerized products.

Accordingly, in an electrophotographic photosensitive member that has a surface layer that contains a polymerized product obtained by polymerization of the charge transporting compound described in these documents, discharge products may penetrate inside the surface layer through non-dense portions or insufficiently polymerized portions in the polymerized product. Thus, not only the surface of the surface layer but also the charge transporting compound (charge transporting structure) inside is likely to undergo modification and thus image defects caused by the modification easily occur.

In contrast, a charge transporting compound having a monovalent group represented by formula (1) according to this embodiment gives a polymerized product at a high polymerization efficiency as with the charge transporting compound having an acryloyloxy group or a methacryloyloxy group. Since the straight alkyls group represented by $R^1$ and/or $R^2$ in formula (1) provide appropriate steric hindrance, polymerization of a charge transporting structure in a twisted state caused by rapid polymerization reaction is suppressed and a dense polymerized product is obtained. Unlike the charge transporting compound having a cinnamoyloxy group, deactivation of radicals prior to polymerization reactions rarely occurs. Accordingly, discharge products are suppressed from penetrating inside the surface layer of the electrophotographic photosensitive member through the non-dense portions and insufficiently polymerized portions in the polymerized product. The inventors assume that, as a result of this, modification of the charge transporting compound (charge transporting structure) inside the surface layer is suppressed and the image defects caused by the modification are suppressed.

As discussed above, at least one of $R^1$ and $R^2$ in formula (1) is a straight alkyl group (unsubstituted straight alkyl group). If both $R^1$ and $R^2$ are hydrogen atoms as in the acryloyloxy group or the methacryloyloxy group, rapid polymerization reactions tend to occur while the charge transporting structure remains twisted and the resulting polymerized product tends to contain non-dense portions. Thus, the effects of the present invention are not achieved. If $R^1$ and $R^2$ are each an alkyl group having a hydrogen atom substituted by another atom (for example, a fluorinated methyl group) or a non-straight alkyl group that has a branched side chain (for example, an isopropyl group), the influence of the steric hindrance is likely to be excessively large. Thus, the polymerization reaction tends to be insufficient and the effects of the present invention are not achieved.

The charge transporting compound having a polymerizable functional group represented by formula (1) above may be a charge transporting compound having a polymerizable functional group represented by formula (2) below from the viewpoint of obtaining a dense polymerized product; the monovalent group represented by formula (2) below includes the monovalent group represented by formula (1) above:

(2)

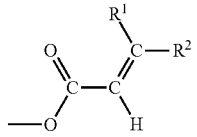

$R^1$ and $R^2$ in formula (2) are the same as $R^1$ and $R^2$ in formula (1). That is, $R^1$ and $R^2$ in formula (2) each independently represent a hydrogen atom or a straight alkyl group and at least one of $R^1$ and $R^2$ is a straight alkyl group.

Examples of the straight alkyl group represented by $R^1$ and $R^2$ in formulae (1) and (2) include a methyl group, an ethyl group, a n-propyl group, a n-butyl group, a n-pentyl group, a n-hexyl group, a n-heptyl group, and a n-octyl group. Among these, a methyl group, an ethyl group, and a n-propyl group are preferable for ease of achieving sufficient polymerization reaction. More preferably, in formulae (1) and (2), $R^1$ is a hydrogen atom and $R^2$ is a methyl group, an ethyl group, or a n-propyl group.

The charge transporting compound having a monovalent group represented by formula (1) above is more desirably a compound represented by formula (3) or (4) below since the charge transporting structure does not easily become twisted during polymerization reaction. Both a compound represented by formula (3) and a compound represented by formula (4) may be used in combination.

(3)

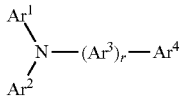

In formula (3) above, $Ar^1$, $Ar^2$, and $Ar^4$ each independently represent a monovalent group represented by formula (M1) below or a substituted or unsubstituted aryl group. $Ar^3$ represents a divalent group represented by formula (M2) below or a substituted or unsubstituted arylene group. At least one of $Ar^1$ to $Ar^4$ represents a monovalent group represented by formula (M1) below or a divalent group represented by formula (M2) below, and r is 0 or 1. When none of $Ar^1$, $Ar^2$, and $Ar^4$ is a monovalent group represented by formula (M1) below, r is 1 and $Ar^3$ is a divalent group represented by formula (M2) below.

(4)

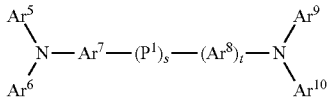

In formula (4) above, $Ar^5$, $Ar^6$, $Ar^9$, and $Ar^{10}$ each independently represent a monovalent group represented by formula (M1) below or a substituted or unsubstituted aryl group. $Ar^7$ and $Ar^8$ each independently represent a divalent group represented by formula (M2) below or a substituted or unsubstituted arylene group. At least one of $Ar^5$ to $Ar^{10}$ is a monovalent group represented by formula (M1) below or a divalent group represented by formula (M2) below. $P^1$ represents an oxygen atom, a cycloalkylidene group, a divalent group having two phenylene groups bonded through an oxygen atom, or an ethylene group and s and t each independently represent 0 or 1. When none of $Ar^5$, $Ar^6$, $Ar^9$, and $Ar^{10}$ is a monovalent group represented by formula (M1) below and $Ar^7$ is not a divalent group represented by formula (M2) below, t is 1 and $Ar^8$ is a divalent group represented by formula (M2) below.

(M1)

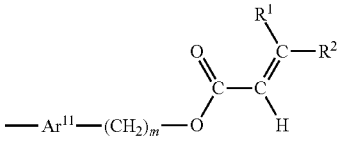

$R^1$ and $R^2$ in formula (M1) are the same as $R^1$ and $R^2$ in formula (1). That is, in formula (M1), $R^1$ and $R^2$ each independently represent a hydrogen atom or a straight alkyl group. At least one of $R^1$ and $R^2$ is a straight alkyl group. In formula (M1) above, $Ar^{11}$ represents a substituted or unsubstituted arylene group and m represents an integer of 1 or more.

(M2)

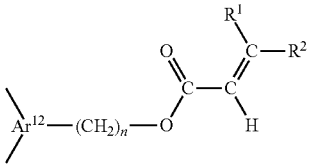

$R^1$ and $R^2$ in formula (M2) above are the same as $R^1$ and $R^2$ in formula (1). That is, $R^1$ and $R^2$ in formula (M2) each independently represent a hydrogen atom or a straight alkyl group. At least one of $R^1$ and $R^2$ is a straight alkyl group. In formula (M2) above, $Ar^{12}$ represents a substituted or unsubstituted trivalent aromatic hydrocarbon group and n represents an integer of 1 or more.

Examples of the aryl group include a phenyl group, a biphenylyl group, and a fluorenyl group. Examples of the substituent that may be included in the aryl group include a carboxyl group, a cyano group, an amino group, an amino group substituted with an alkyl group, a hydroxy group, an alkoxy group, an alkyl group, an alkyl group substituted with a halogen atom, and a halogen atom. Examples of the amino group substituted with an alkyl group include a dimethylamino group and a diethyl amino group. Examples of the alkoxy group include a methoxy group and an ethoxy group. Examples of the alkyl group include a methyl group, an ethyl group, and a n-propyl group. Examples of the alkyl group substituted with a halogen atom include a trifluoromethyl group. Examples of the halogen atom include a fluorine atom, a chlorine atom, and a bromine atom. Examples of the substituted fluorenyl group include a 9,9-dimethylfluorenylene group.

Examples of the arylene group include a phenylene group, a biphenylylene group, and a fluorenylylene group. Examples of the substituent that may be contained in the arylene group include a carboxyl group, a cyano group, an amino group, an amino group substituted with an alkyl group, a hydroxy group, an alkoxy group, an alkyl group, an alkyl group substituted with a halogen atom, and a halogen atom. Examples of the amino group substituted with an alkyl group include a dimethylamino group and a diethylamino group. Examples of the alkoxy group include a methoxy group and an ethoxy group. Examples of the alkyl group include a methyl group, an ethyl group, and a n-propyl group. Examples of the alkyl group substituted with a halogen atom include a trifluoromethyl group. Examples of the halogen atom include a fluorine atom, a chlorine atom, and a bromine atom. Examples of the substituted fluorenyl group include a 9,9-dimethylfluorenylene group.

Examples of the cycloalkylidene group include a cyclopropylidene group, a cyclobutylidene group, a cyclopentylidene group, a cyclohexylidene group, a cycloheptylidene group, and a cyclooctylidene group.

Examples of the trivalent aromatic hydrocarbon group include trivalent groups derived by removing three hydrogen atoms from an aromatic hydrocarbon such as benzene, biphenyl, or fluorene. Examples of the substituent that may be contained in the trivalent aromatic hydrocarbon group include a carboxyl group, a cyano group, an amino group, an amino group substituted with an alkyl group, a hydroxy group, an alkoxy group, an alkyl group, an alkyl group substituted with a halogen atom, and a halogen atom. Examples of the amino group substituted with an alkyl group include a dimethylamino group and a diethylamino group. Examples of the alkoxy group include a methoxy group and an ethoxy group. Examples of the alkyl group include a methyl group, an ethyl group, and a n-propyl group. Examples of the alkyl group substituted with a halogen atom include a trifluoromethyl group. Examples of the halogen atom include a fluorine atom, a chlorine atom, and a bromine atom.

In formula (3), at least two of $Ar^1$ to $Ar^4$ may each represent a monovalent group represented by formula (M1) above or a divalent group represented by formula (M2) above in order to easily obtain a dense polymerized product. In formula (4), at least two of $Ar^5$ to $Ar^{10}$ may each represent a monovalent group represented by formula (M1) above or a divalent group represented by formula (M2) above.

In formula (M1), m may represent an integer of 2 or more and 5 or less to easily obtain a dense polymerized product. In formula (M2), n may be an integer of 2 or more and 5 or less.

In forming the surface layer of the electrophotographic photosensitive member, one or more types of the charge transporting compound having a polymerizable functional group represented by formula (1) above may be used.

The charge transporting compound having a polymerizable functional group represented by formula (1) above may be synthesized through a synthetic method described in, for example, Japanese Patent Laid-Open No. 2000-066425 or 2010-156835.

Specific examples (Example Compounds) of the charge transporting compound having a polymerizable functional group represented by formula (1) above are described below. These examples do not limit the scope of the present invention.

(C-1-1)

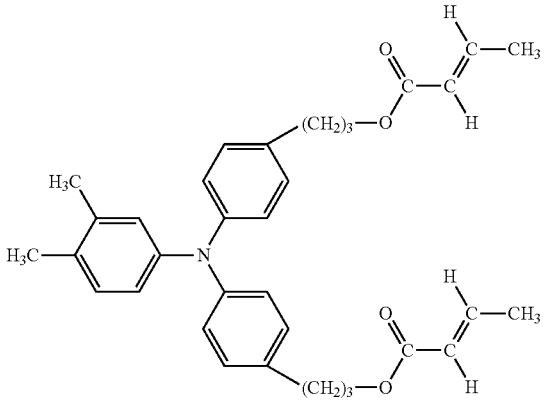

(C-1-2)

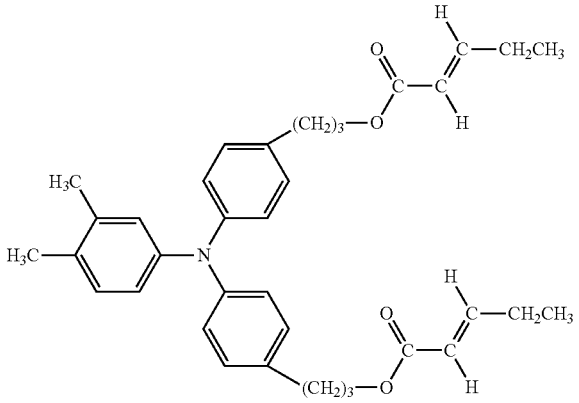

(C-1-3)

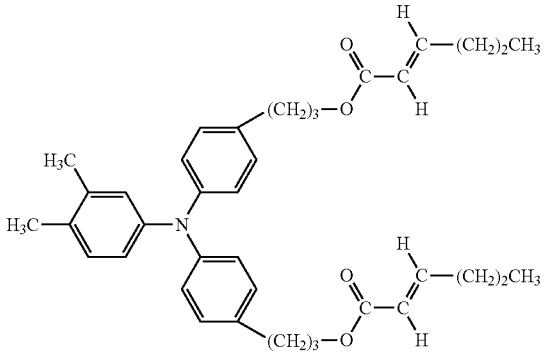

(C-1-4)

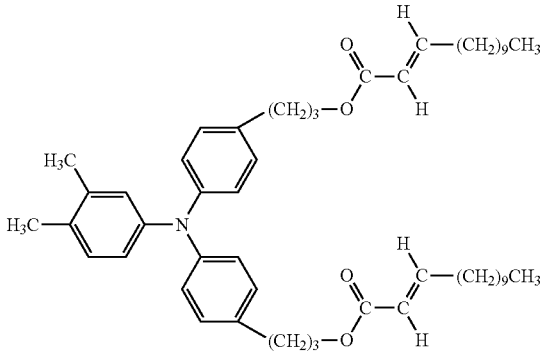

(C-1-5)

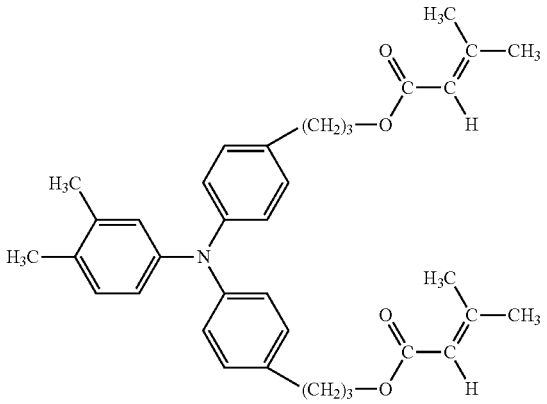

-continued
(C-1-6)
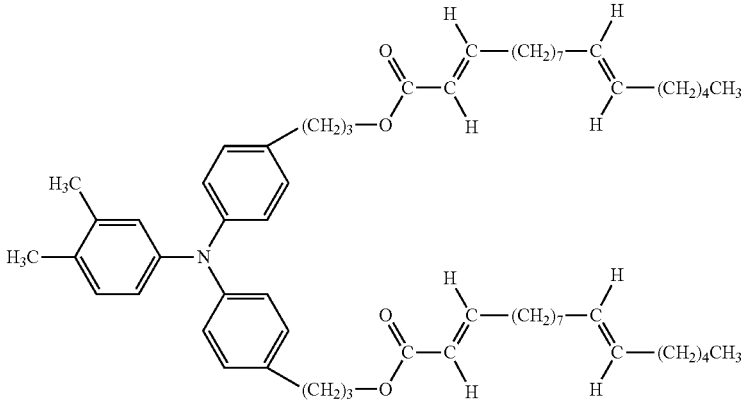
(C-1-7)
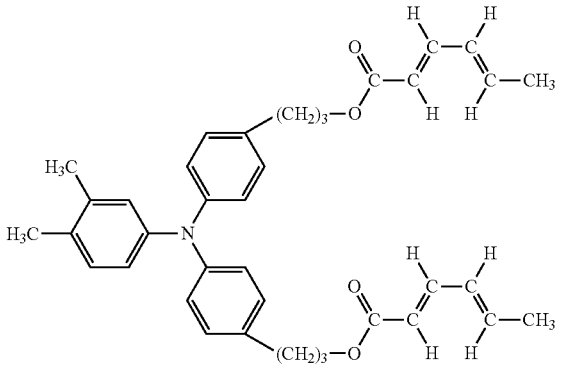
(C-1-8)
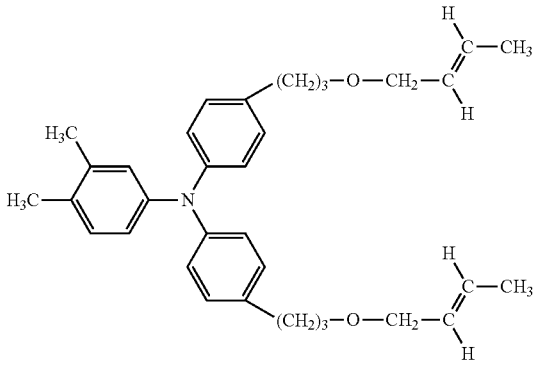
(C-1-9)
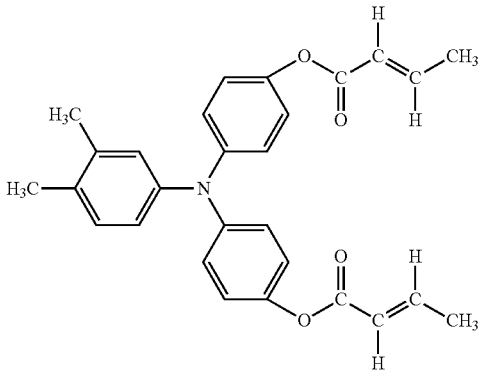
(C-1-10)
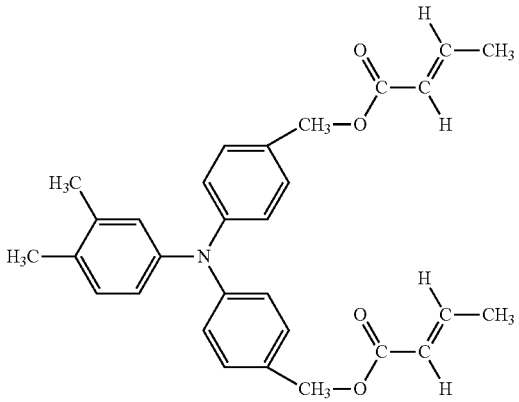
(C-1-11)
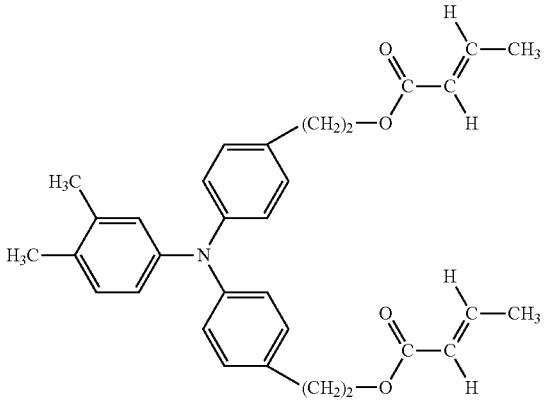
(C-1-12)
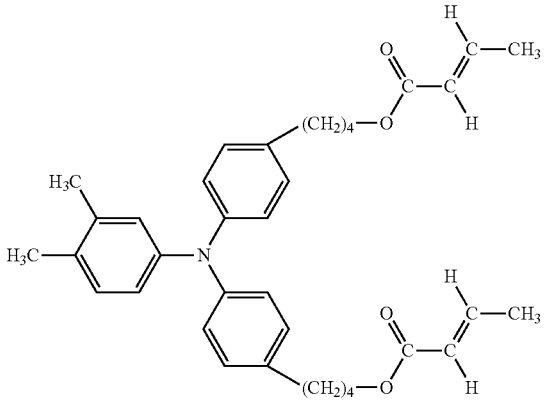

-continued
(C-1-13)
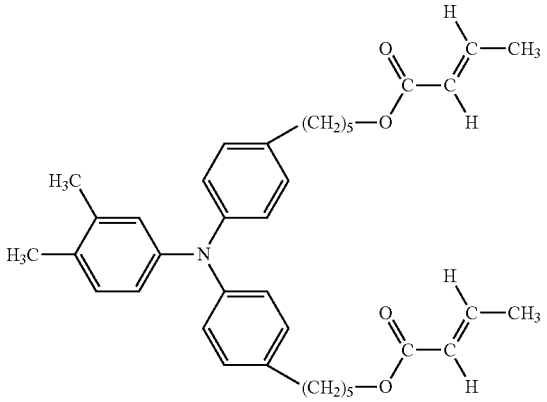
(C-1-14)
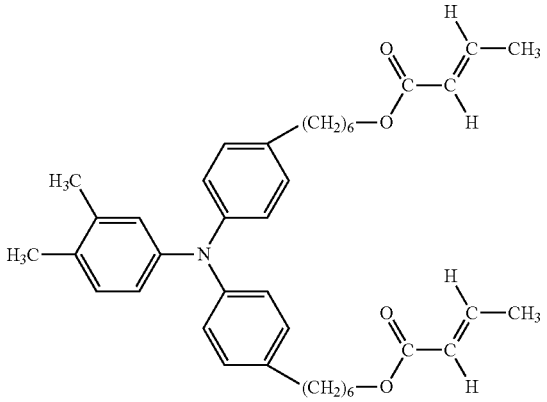
(C-1-15)
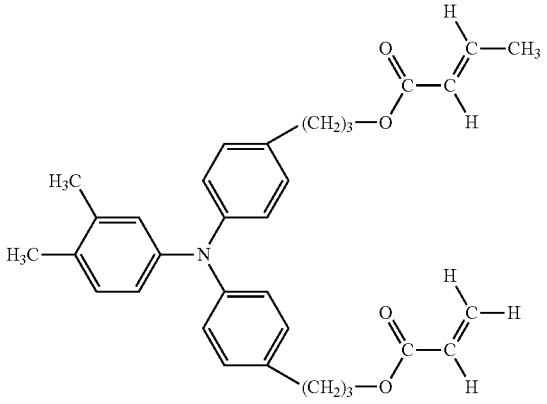
(C-1-16)
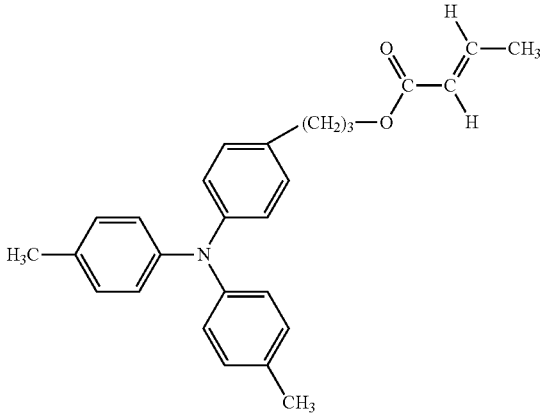
(C-1-17)
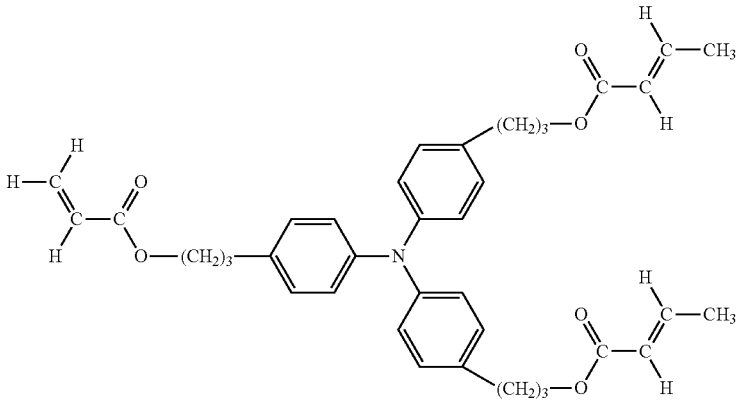

-continued
(C-1-18)
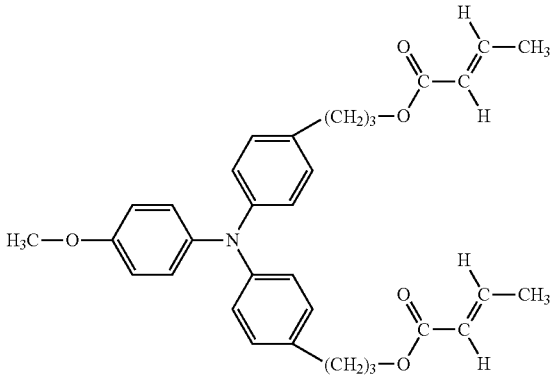
(C-1-19)
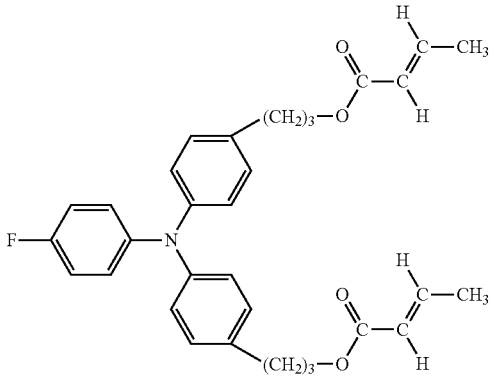
(C-1-20)
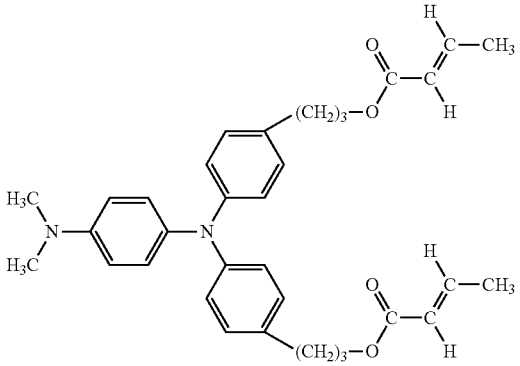
(C-1-21)
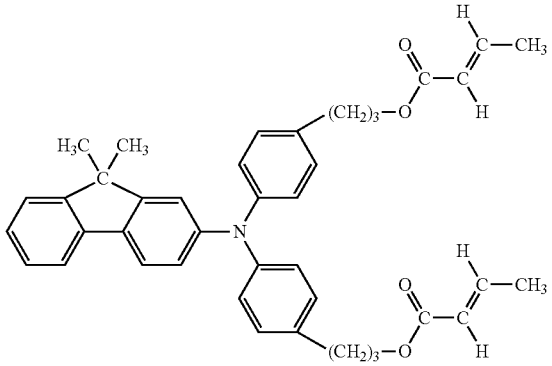
(C-2-1)
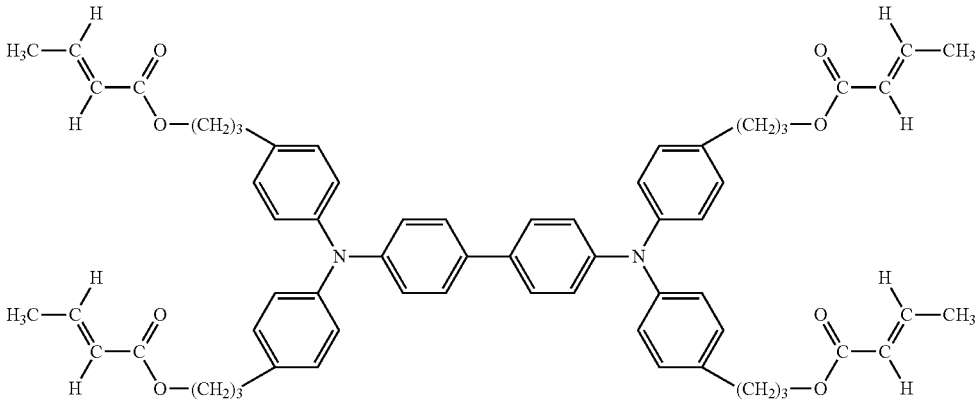
(C-2-2)
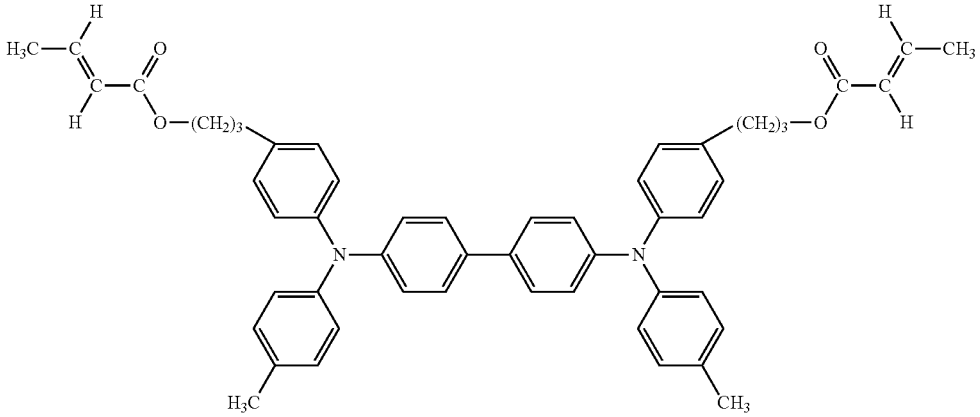

-continued
(C-2-3)
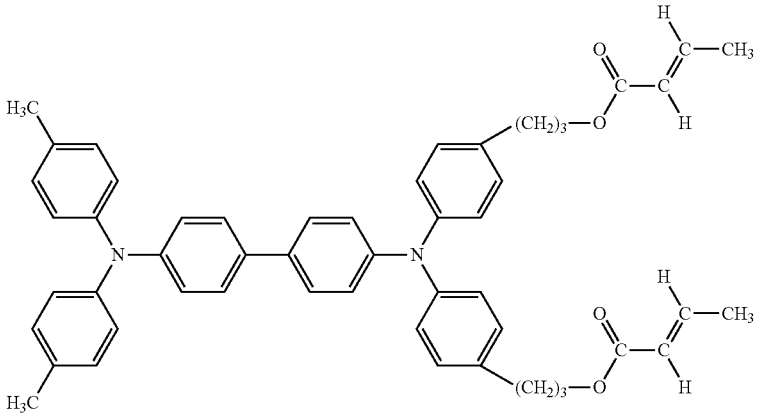
(C-3-1)
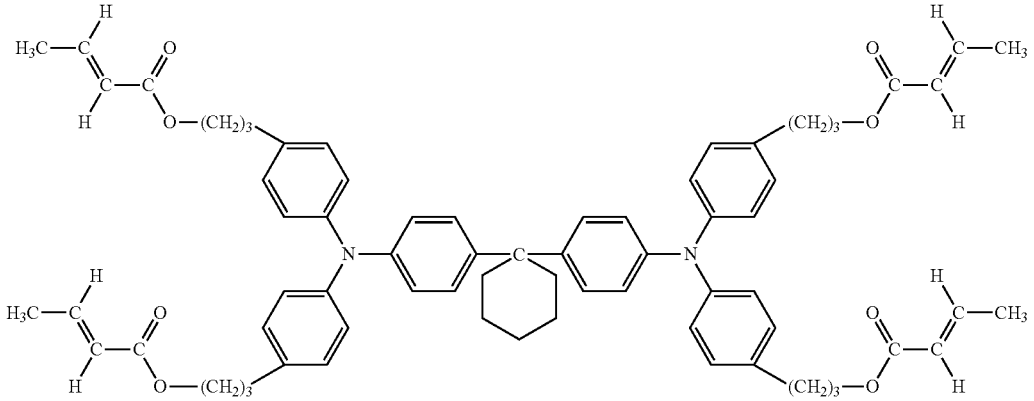
(C-3-2)
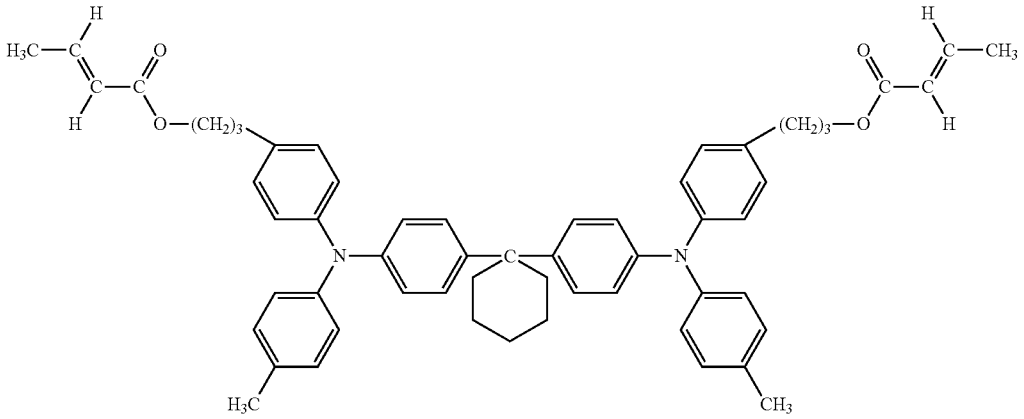

-continued
(C-3-3)
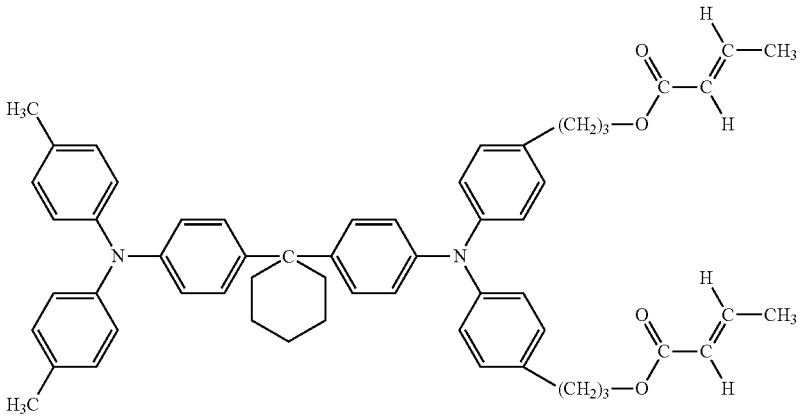
(C-4-1)
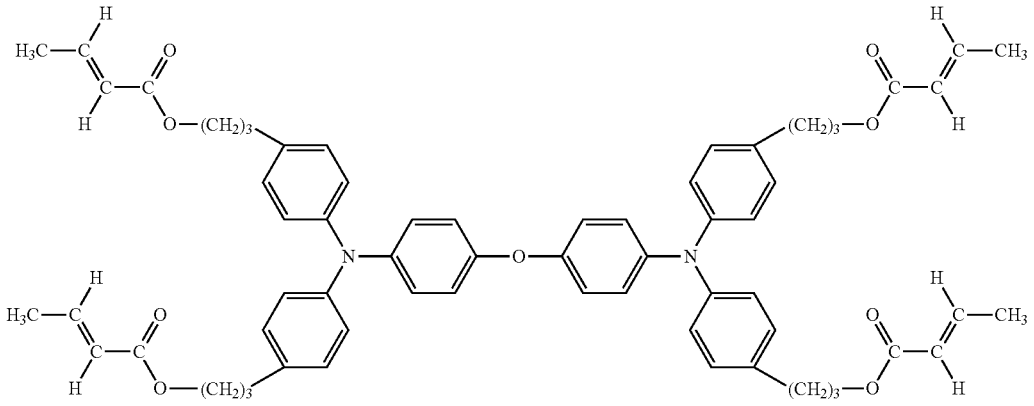
(C-4-2)
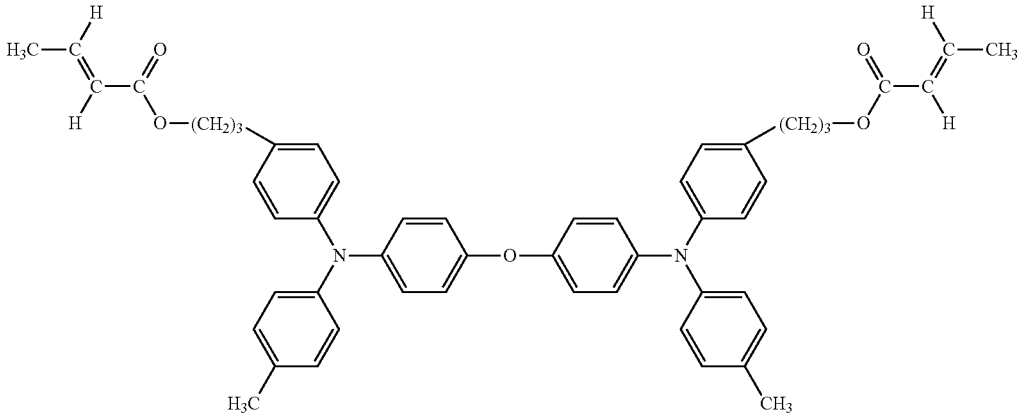

-continued (C-4-3)

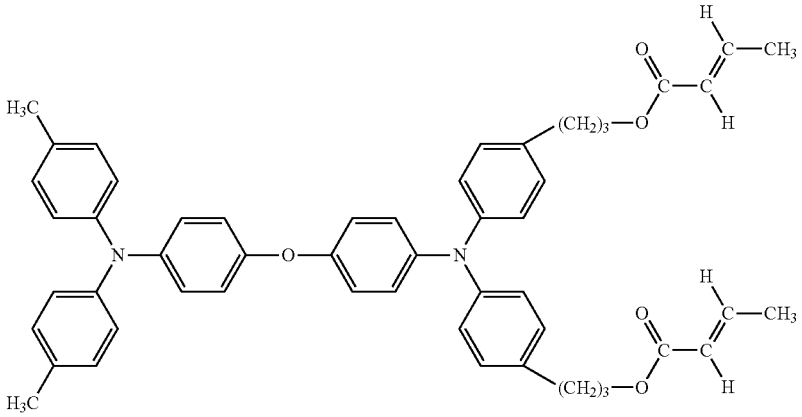

(C-5-1)

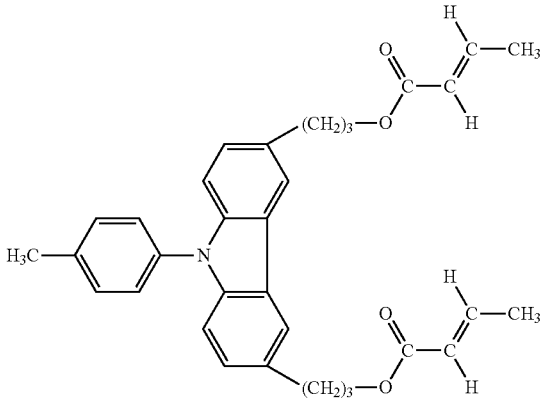

Of these compounds, Example Compound (C-1-1) is particularly preferable.

The surface layer can be formed by forming a coat by using a surface layer-forming coating solution containing a composition that contains a charge transporting compound having a polymerizable functional group represented by formula (1) and polymerizing the composition contained in the coat.

The composition may contain a compound other than the charge transporting compound in addition to the charge transporting compound having a monovalent group represented by formula (1).

The compound other than the charge transporting compound may be a compound (urea compound) represented by formula (B) or (C) below since modification of the charge transporting compound (charge transporting structure) inside the surface layer caused by repetitive use can be suppressed without suppressing the polymerization reaction. A compound represented by formula (B) and a compound represented by formula (C) may be used in combination.

(B)

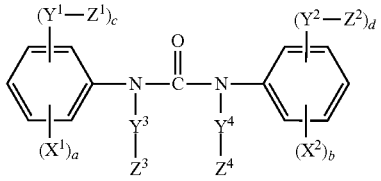

In formula (B), $X^1$ and $X^2$ each independently represent a methyl group, an ethyl group, a n-propyl group, a methoxymethyl group, a trifluoromethyl group, a trichloromethyl group, a methoxy group, an ethoxy group, a propoxy group, a methoxymethoxy group, a trifluoromethoxy group, a trichloromethoxy group, a dimethylamino group, or a fluorine atom. $Y^1$ and $Y^2$ each independently represent an alkylene group. $Z^1$ to $Z^4$ each independently represent a hydrogen atom, an acryloyloxy group, a methacryloyloxy group, a monovalent group represented by formula (5) below, or a monovalent group represented by formula (6) below. At least one of $Z^1$ to $Z^4$ represents an acryloyloxy group, a methacryloyloxy group, a monovalent group represented by formula (5) below, or a monovalent group represented by formula (6) below. In formula (B), a and b each independently represent an integer of 0 or more and 5 or less and c and d each independently represent 0 or 1.

(C)

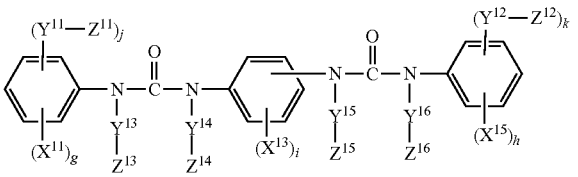

In formula (C), $X^{11}$ to $X^{13}$ each independently represent a methyl group, an ethyl group, a n-propyl group, a methoxymethyl group, a trifluoromethyl group, a trichloromethyl group, a methoxy group, an ethoxy group, a propoxy group, a methoxymethoxy group, a trifluoromethoxy group, a trichloromethoxy group, a dimethylamino group, or a fluorine atom. $Y^{11}$ to $Y^{16}$ each independently represent an alkylene group. $Z^{11}$ to $Z^{16}$ each independently represent a hydrogen atom, an acryloyloxy group, a methacryloyloxy group, a monovalent group represented by formula (5) below, or a monovalent group represented by formula (6) below. At least one of $Z^{11}$ to $Z^{16}$ is an acryloyloxy group, a methacryloyloxy group, a monovalent group represented by formula (5) below, or a monovalent group represented by formula (6) below. In formula (C), g and h each independently represent an integer of 0 or more and 5 or less, i represents an integer of 0 or more and 4 or less, and j and k each independently represent 0 or 1.

(5)

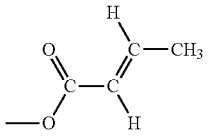

(6)

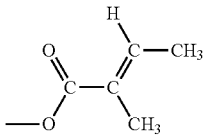

The acryloyloxy group is a monovalent group represented by the following formula:

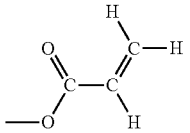

The methacryloyloxy group is a monovalent group represented by the following formula:

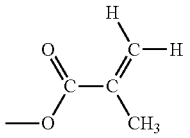

Various additives may be added to the surface layer. Examples of the additive include deterioration inhibitors such as an antioxidant and an ultraviolet absorber, lubricants such as polytetrafluoroethylene (PTFE) particles and fluorinated carbon, polymerization controllers such as a polymerization initiator and a polymerization terminator, a leveling agent such as silicone oil, and a surfactant.

Examples of the solvent used in preparing the surface layer-forming coating solution include alcohol-based solvents such as methanol, ethanol, and propanol, ketone-based solvents such as acetone, methyl ethyl ketone, and cyclohexanone, ester-based solvents such as ethyl acetate and butyl acetate, ether-based solvents such as tetrahydrofuran and dioxane, halogen-based solvents such as 1,1,2,2,3,3,4-heptafluorocyclopentane, dichloromethane, dichloroethane, and chlorobenzene, aromatic solvents such as benzene, toluene, and xylene, and cellosolve-based solvents such as methyl cellosolve and ethyl cellosolve. These solvents may be used alone or in combination as a mixture.

The electrophotographic photosensitive member includes a support and a photosensitive layer formed on the support as mentioned above.

The photosensitive layer is either a single layer-type photosensitive layer in which a charge generating substance and a charge transporting substance are contained in the same layer or a multilayer-type (separated function) photosensitive layer in which a charge generating layer containing charge generating substance and a charge transporting layer containing a charge transporting substance are separately provided. In the present invention, a multilayer-type photosensitive layer is favored. The charge generating layer and the charge transporting layer may each have a multilayered structure.

Figure 1B:
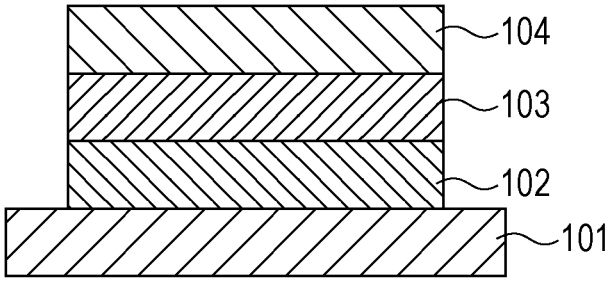

FIG. 1A and FIG. 1B are diagrams showing examples of layer configurations of the electrophotographic photosensitive member. In FIG. 1A, a charge generating layer 102 is disposed on a support 101 and a charge transporting layer 103 is disposed on the charge generating layer 102. In FIG. 1B, a protective layer 104 (second charge transporting layer) is formed on the charge transporting layer 103.

In an embodiment of the present invention, a conductive layer and/or an undercoat layer described below may be provided between the support and the photosensitive layer (charge generating layer or charge transporting layer) if needed. For the purposes of the present invention, the surface layer of an electrophotographic photosensitive member refers to the outermost layer (layer farthest from the support) among the layers of the electrophotographic photosensitive member. For example, in the case of the electrophotographic photosensitive member shown in FIG. 1A, the surface layer of the electrophotographic photosensitive member is the charge transporting layer 103. In the case of the electrophotographic photosensitive member shown in FIG. 1B, the surface layer is the protective layer (second charge transporting layer) 104.

The support included in the electrophotographic photosensitive member may be a support that has electrical conductivity (conductive support). Examples of the support include those composed of metal (alloy) such as aluminum, an aluminum alloy, or stainless steel. In the case of using an aluminum or aluminum alloy support, an ED pipe, an EI pipe, or a pipe obtained by conducting cutting, electro-chemical buffing, and wet or dry honing on an ED pipe or an EI pipe may be used. A metal support or a resin support on which a thin film of a conductive material such as aluminum, an aluminum alloy, or an indium oxide-tin oxide alloy is formed may also be used as the support.

The surface of the support may be subjected to a cutting process, a roughening treatment, an anodizing treatment, or the like.

A resin support impregnated with conductive particles such as carbon black, tin oxide particles, titanium oxide particles, or silver particles, or a conductive resin support may also be used.

A conductive layer that contains conductive particles and a binder resin may be provided between the support and the photosensitive layer or the undercoat layer described below.

The conductive layer can be formed by applying a conductive layer-forming coating solution obtained by dispersing conductive particles in a binder resin and a solvent and drying and/or curing the resulting coat.

Examples of the conductive particles used in the conductive layer include carbon black, acetylene black, metal particles such as aluminum, nickel, iron, nichrome, copper, zinc, and silver particles, and metal oxide particles such as tin oxide and indium tin oxide (ITO) particles.

Examples of the resin used in the conductive layer include acrylic resin, alkyd resin, epoxy resin, phenolic resin, butyral resin, polyacetal, polyurethane, polyester, polycarbonate, and melamine resin.

Examples of the solvent used in the conductive layer-forming coating solution include ether-based solvents, alcohol-based solvents, ketone-based solvents, and aromatic hydrocarbon-based solvents.

The thickness of the conductive layer is preferably 0.2 μm or more and 40 μm or less and more preferably 5 μm or more and 40 μm or less.

An undercoat layer may be provided between the support and the conductive layer or the photosensitive layer.

The undercoat layer can be formed by applying an undercoat layer-forming coating solution containing a resin and drying or curing the resulting coat.

Examples of the resin used in the undercoat layer include polyacrylic acid, methyl cellulose, ethyl cellulose, polyamide, polyimide, polyamideimide, polyamic acid, melamine resin, epoxy resin, and polyurethane.

The undercoat layer may contain the conductive particles described above, semiconducting particles, an electron transporting substance, and an electron accepting substance.

Examples of the solvent used in the undercoat layer-forming coating solution include ether-based solvents, alcohol-based solvents, ketone-based solvents, and aromatic hydrocarbon-based solvents.

The thickness of the undercoat layer is preferably 0.05 μm or more and 40 μm or less and more preferably 0.4 μm or more and 20 μm or less.

A photosensitive layer (charge generating layer or charge transporting layer) is formed on the support, the conductive layer, or the undercoat layer.

Examples of the charge generating substance include pyrylium, thiapyrylium dyes, phthalocyanine compounds, anthanthrone pigments, dibenzpyrenequinone pigments, pyranthrone pigments, azo pigments, indigo pigments, quinacridone pigments, and quinocyanine pigments. Among these, gallium phthalocyanine is preferable. From the viewpoint of high sensitivity, hydroxygallium phthalocyanine is more preferable and hydroxygallium phthalocyanine crystals that have intense peaks at Bragg angles 2θ of 7.4°±0.3° and 28.2°±0.3° in CuK α X-ray diffraction are particularly preferable.

When the photosensitive layer is a multilayered photosensitive layer, a binder resin used in the charge generating layer may be polycarbonate, polyester, butyral resin, polyvinyl acetal, acrylic resin, vinyl acetate resin, or urea resin, for example. Among these, butyral resin is preferable. These resins may be used alone or in combination as a mixture or a copolymer.

The charge generating layer may be formed by applying a charge generating layer-forming coating solution obtained by dispersing a charge generating substance in a binder resin and a solvent and drying the resulting coat. The charge generating layer may be a film prepared by vapor deposition of a charge generating substance.

In the charge generating layer, the amount of the binder resin is preferably 0.3 parts by mass or more and 4 parts by mass or less relative to 1 part by mass of the charge generating substance.

Examples of the method for carrying out the dispersion treatment include methods that use a homogenizer, ultrasonic waves, a ball mill, a sand mill, an attritor, and a roll mill.

Examples of the solvent used in the charge generating layer-forming coating solution include alcohol-based solvents, sulfoxide-based solvents, ketone-based solvents, ether-based solvents, ester-based solvents, and aromatic hydrocarbon-based solvents.

The thickness of the charge generating layer is preferably 0.01 μm or more and 5 μm or less and more preferably 0.1 μm or more and 1 μm or less.

Various additives such as a sensitizer, an antioxidant, a UV absorber, and a plasticizer may be added to the charge generating layer if needed.

In the case where the photosensitive layer is a multilayered photosensitive layer constituted by a charge generating layer and a charge transporting layer stacked in that order from the support side, a charge transporting layer is formed on the charge generating layer.

In the case where the charge transporting layer is a surface layer as shown in FIG. 1A, the charge transporting layer is prepared as follows. That is, a coat is formed by using a charge transporting layer-forming coating solution (surface layer-forming coating solution) containing a composition containing a charge transporting compound having a polymerizable functional group represented by formula (1) above. Then the composition in the coat is polymerized (chain polymerization) to form the charge transporting layer.

In the case where the protective layer (second charge transporting layer) is the surface layer as shown in FIG. 1B, the charge transporting layer (first charge transporting layer) that is not the surface layer is prepared as follows. That is, a coat is formed by applying a charge transporting layer-forming coating solution obtained by dissolving a charge transporting substance and a binder resin in a solvent. Then the coat is dried to form the charge transporting layer (first charge transporting layer).

Examples of the charge transporting substance used in the layer (charge transporting layer) that is not the surface layer include a triarylamine compound, a hydrazone compound, a stilbene compound, a pyrazoline compound, an oxazole compound, a thiazole compound, and a triarylmethane compound.

Examples of the binder resin used in the charge transporting layer that is not the surface layer include polyvinyl butyral, polyarylate, polycarbonate, polyester, phenoxy resin, polyvinyl acetate, acrylic resin, polyacrylamide, polyamide, polyvinyl pyridine, cellulose resin, urethane resin, epoxy resin, agarose resin, cellulose resin, casein, polyvinyl alcohol, and polyvinyl pyrrolidone. These resins may be used alone or in combination as a mixture or a copolymer.

In the charge transporting layer that is not the surface layer, the amount of the charge transporting substance may be 30% by mass or more and 70% by mass or less relative to the total mass of the charge transporting layer.

Examples of the solvent used in the charge transporting layer-forming coating solution for forming the charge transporting layer that is not the surface layer include ether-based solvents, alcohol-based solvents, ketone-based solvents, and aromatic hydrocarbon-based solvents.

The thickness of the charge transporting layer that is not the surface layer may be 5 μm or more and 40 μm or less.

In the case where a protective layer (second charge transporting layer) that is the surface layer of the electrophotographic photosensitive member is to be formed, the protective layer can be formed as follows. That is, a coat is formed by using a protective layer-forming coating solution obtained by dissolving a charge transporting compound having a polymerizable functional group represented by formula (1) above in a solvent. Then the charge transporting compound having a monovalent group represented by formula (1) contained in the coat is polymerized (chain polymerization) to form the protective layer.

The amount of the charge transporting compound having a polymerizable functional group represented by formula (1) in the protective layer may be 50% by mass or more and 100% by mass or less relative to the total solid content of the protective layer-forming coating solution. The thickness of the protective layer may be 2 μm or more and 20 μm or less.

In applying the coating solution for each layer, a coating method such as a dipping method, a spray coating method, a spinner coating method, a bead coating method, a blade coating method, or a beam coating method may be employed.

Polymerization of the charge transporting compound having a polymerizable functional group represented by formula (1) above can be carried out by using heat, light (ultraviolet light or the like), or a radiation (electron beam or the like). In particular, polymerization using a radiation is preferable and polymerization using an electron beam among radiations is more preferable.

Polymerization using an electron beam yields a significantly dense (high density) three dimensional network structure and a high potential stability is achieved. Moreover, since the polymerization takes a short time and is efficient, the productivity will be increased. Examples of the accelerator used to emit the electron beam include a scanning type accelerator, an electrocurtain type accelerator, a broad beam type accelerator, a pulse type accelerator, and a laminar type accelerator.

If an electron beam is to be used, the acceleration voltage of the electron beam may be 120 kV or less since degradation of the properties of the materials by the electron beam can be suppressed without decreasing the polymerization efficiency. The electron beam absorbed dose at the surface of the coat of the surface layer-forming coating solution is preferably 5 kGy or more and 50 kGy or less and more preferably 1 kGy or more and 10 kGy or less.

In the case where a charge transporting compound having a polymerizable functional group represented by formula (1) above is to be polymerized by using an electron beam, heating in an inert gas atmosphere is preferably performed after irradiation with an electron beam in an inert gas atmosphere in order to suppress the polymerization inhibiting effect of oxygen. Examples of the inert gas include nitrogen, argon, and helium.

Figure 2:
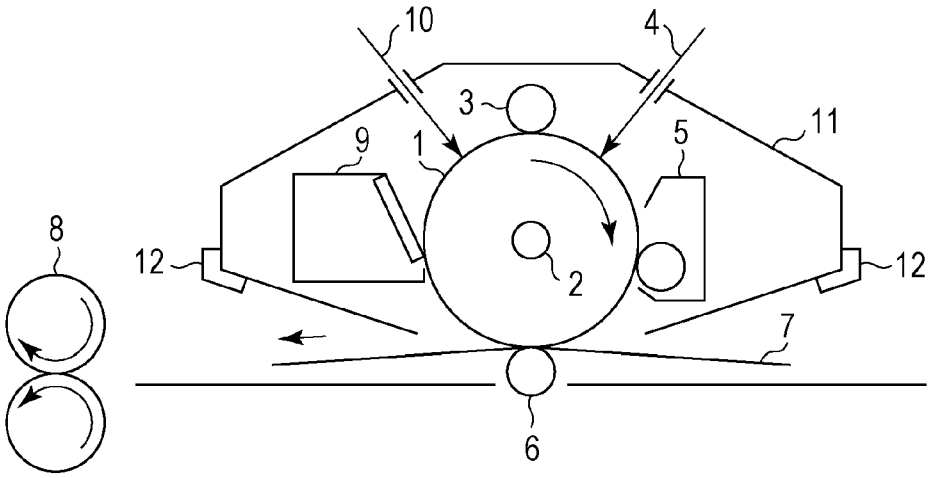
FIG. 2 is a diagram showing an example of a schematic structure of an electrophotographic apparatus equipped with a process cartridge including an electrophotographic photosensitive member.

FIG. 2 shows an example of a schematic structure of an electrophotographic apparatus that includes a process cartridge including an electrophotographic photosensitive member according to an embodiment of the present invention.

Referring to FIG. 2, an electrophotographic photosensitive member 1 having a cylindrical shape (drum shape) is rotated at a particular peripheral speed (process speed) in the arrow direction about a shaft 2. The surface (peripheral surface) of the electrophotographic photosensitive member 1 is negatively or positively charged with a charging unit (primary charging unit) 3 as the electrophotographic photosensitive member 1 is rotated. Next, the surface of the electrophotographic photosensitive member 1 is irradiated with exposure light (image exposure light) 4 output from an exposure unit (image exposure unit) (not shown in the drawing). The intensity of the exposure light 4 is changed in response to time-series electrical digital image signals of the target image information. Exposure may be conducted by slit exposure, laser beam scanning exposure, or the like. As a result, an electrostatic latent image corresponding to the target image information is formed on the surface of the electrophotographic photosensitive member 1.

The electrostatic latent image formed on the surface of the electrophotographic photosensitive member 1 is developed (normal development or reversal development) with a toner contained in a development unit 5 into a toner image. The toner image formed on the surface of the electrophotographic photosensitive member 1 is transferred onto a transfer material 7 by a transfer unit 6. When the transfer material 7 is a sheet of paper, the transfer material 7 is taken up in synchronization with rotation of the electrophotographic photosensitive member 1 from a paper feeder (not shown) and fed to the gap between the electrophotographic photosensitive member 1 and the transfer unit 6. A bias voltage having a polarity opposite to the charges retained in the toner is applied to the transfer unit 6 from a bias power supply (not shown). The transfer unit may be an intermediate transfer-type transfer unit that includes a primary transfer member, an intermediate transfer material, and a secondary transfer member.

The transfer material 7 onto which the toner image has been transferred is separated from the surface of the electrophotographic photosensitive member 1 and conveyed to a fixing unit 8. The toner image is fixed and an image printout (print or copy) is discharged from the electrophotographic apparatus.

The surface of the electrophotographic photosensitive member 1 after the transfer of the toner image is cleaned with a cleaning unit 9 to remove adhering matters such as transfer residual toner. The transfer residual toner may be recovered through a development unit or the like. If needed, the surface of the electrophotographic photosensitive member 1 is subjected to a charge erasing treatment by irradiation with preexposure light 10 from a preexposure unit (not shown) and then again used in forming an image. If the charging unit 3 is a contact charging unit such as a charging roller, the preexposure unit is not always necessary.

Two or more selected from the constitutional units such as the electrophotographic photosensitive member 1, the charging unit 3, the development unit 5, the transfer unit 6, and the cleaning unit 9 may be housed in a container to form a process cartridge. The process cartridge may be configured to be detachably attachable to a main unit of an electrophotographic apparatus. For example, the electrophotographic photosensitive member 1 and at least one selected from the group consisting of the charging unit 3, the development unit 5, the transfer unit 6, and the cleaning unit 9 are integrally supported to form a cartridge. A process cartridge 11 that is detachably attachable to a main unit of an electrophotographic apparatus through a guiding unit 12 such as a rail in the electrophotographic apparatus can be made thereby.

EXAMPLES

The present invention will now be described in more detail through Examples and Comparative Examples below. Note that "parts" means "parts by mass" in Examples below.

Example 1

An aluminum cylinder having a diameter of 30 mm, a length of 357.5 mm, and a thickness of 1 mm was used as support (conductive support).

Into a sand mill containing glass beads 0.8 mm in diameter, 50 parts of titanium oxide particles coated with tin oxide containing 10% antimony oxide (trade name: ECT-62, produced by Titan Kogyo Ltd.), 25 parts of resole-type phenolic resin (trade name: PHENOLITE J-325, produced by DIC Corporation, solid content: 70% by mass), 20 parts of methyl cellosolve, 5 parts of methanol, and 0.002 parts of a silicone oil (polydimethylsiloxane/polyoxyalkylene copolymer, average molecular weight: 3000) were placed and dispersed for 2 hours to prepare a conductive layer-forming coating solution. The support was dip-coated with the conductive layer-forming coating solution and the resulting coat was dried and cured at 150° C. for 30 minutes. As a result, a conductive layer having a thickness of 20 μm was formed.

Next, 2.5 parts of a nylon 6-66-610-12 quaternary copolymer (trade name: CM8000, produced by Toray Corporation) and 7.5 parts of N-methoxymethylated 6 nylon resin (trade name: Toresin EF-30T, produced by Nagase ChemteX Corporation) were dissolved in a mixed solvent containing 100 parts of methanol and 90 parts of butanol to prepare an undercoat layer-forming coating solution. The undercoat layer-forming coating solution was applied to the conductive layer by dip coating and the resulting coat was dried at 100° C. for 10 minutes to form an undercoat layer having a thickness of 0.5 μm.

Next, 11 parts of hydroxygallium phthalocyanine crystals (intense peaks at Bragg angles (2θ±0.2°) of 7.4° and 28.2° in CuK α X-ray diffraction) serving as a charge generating substance, 5 parts of polyvinyl butyral (trade name: S-LEC BX-1 produced by Sekisui Chemical Co., Ltd.), and 130 parts of cyclohexanone were mixed. To the resulting mixture, 500 parts of glass beads 1 mm in diameter were added and the mixture was dispersed for 2 hours at 1800 rpm while being cooled with 18° C. cooling water. After the dispersion treatment, the mixture was diluted with 300 parts of ethyl acetate and 160 parts of cyclohexanone to prepare a charge generating layer-forming coating solution. The charge generating layer-forming coating solution was applied to the undercoat layer by dip coating and the resulting coat was dried at 110° C. for 10 minutes to form a charge generating layer having a thickness of 0.16 μm. The average particle size (median) of the hydroxygallium phthalocyanine crystals in the prepared charge generating layer-forming coating solution was measured with a centrifugal particle size distribution analyzer (trade name: CAPA 700, produced by Horiba Ltd.) based on the principle of liquid phase sedimentation and was found to be 0.18 μm.

Next, 5 parts of a compound (charge transporting substance) represented by formula (7)

(7)

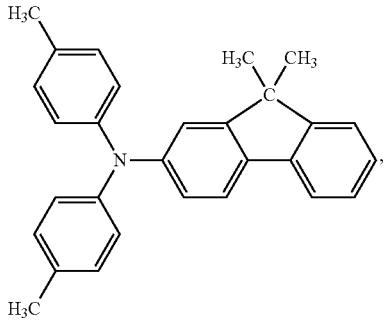

5 parts of a compound (charge transporting substance) represented by formula (8) below (8)

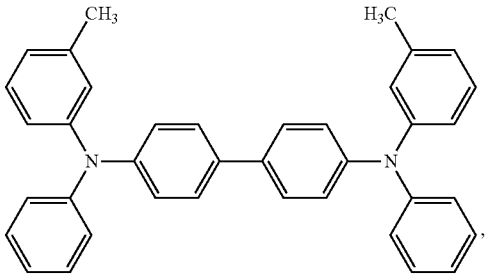

and 10 parts of a polycarbonate (trade name: Iupilon 2400 produced by Mitsubishi Gas Chemical Company, Inc.) were dissolved in a mixed solvent containing 70 parts of monochlorobenzene and 30 parts of dimethoxymethane to prepare a charge transporting layer-forming coating solution. The charge transporting layer-forming coating solution was applied to the charge generating layer by dip coating and the resulting coat was dried at 100° C. for 30 minutes to form a charge transporting layer (first charge transporting layer) having a thickness of 18 μm.

Next, 100 parts of Example Compound (C-1-1) was dissolved in 100 parts of n-propanol and 100 parts of 1,1,2,2,3,3,4-heptafluorocyclopentane (trade name: ZEORORA-H produced by ZEON CORPORATION) was added to the resulting solution to prepare a protective layer-forming coating solution. The protective layer-forming coating solution was applied to the charge transporting layer by dip coating and the resulting coat was heated at 50° C. for 5 minutes. The coat was then irradiated with an electron beam for 1.6 seconds in a nitrogen atmosphere at an acceleration voltage of 70 kV and an absorbed dose of 50000 Gy, and heat treated in a nitrogen atmosphere for 25 seconds under the conditions that the temperature of the coat was 130° C. The oxygen concentration from irradiation with the electron beam to 25 seconds of the heat treatment was 18 ppm. Next, the coat was heat treated for 12 minutes in air under the conditions that the temperature of the coat was 110° C. As a result, a protective layer (second charge transporting layer) having a thickness of 5 μm was formed.

An electrophotographic photosensitive member constituted by a support, a conductive layer, an undercoat layer, a charge generating layer, a charge transporting layer (first charge transporting layer), and a protective layer (second charge transporting layer) as the surface layer was prepared as above.

Example 2

An electrophotographic photosensitive member was prepared as in Example 1 except that the protective layer-forming coating solution was prepared by dissolving 80 parts of Example Compound (C-1-1) and 20 parts of a compound represented by formula (9) below (9)

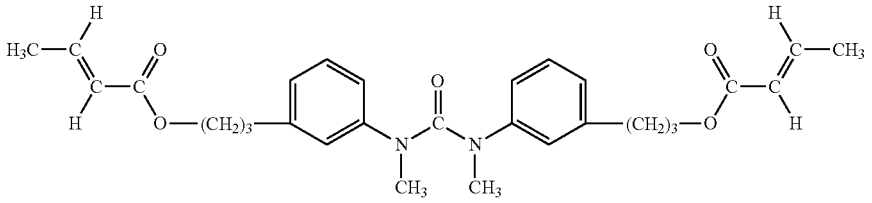

in 100 parts of n-propanol and adding 100 part of 1,1,2,2,3,3,4-heptafluorocyclopentane (trade name: ZEORORA-H produced by ZEON CORPORATION) to the resulting mixture.

Examples 3 to 18

Electrophotographic photosensitive members were prepared as in Example 1 except that Example Compound (C-1-1) in Example 1 was changed to Example Compounds shown in Table 1 in preparing the protective layer-forming coating solution.

Example 19

An electrophotographic photosensitive member was prepared as in Example 1 except for the following points. The protective layer-forming coating solution was changed to one prepared by dissolving 99 parts of Example Compound (C-1-1) and 1 part of 1-hydroxy-cyclohexyl-phenyl-ketone (trade name: IRGACURE 184, produced by Ciba Specialty Chemicals Inc.) in 100 parts of n-propanol and adding 100 parts of 1,1,2,2,3,3,4-heptafluorocyclopentane (trade name: ZEORORA-H produced by ZEON CORPORATION) to the resulting mixture. The protective layer-forming coating solution was applied to the charge transporting layer by dip coating and the resulting coat was heat treated at 50° C. for 5 minutes and then irradiated with ultraviolet light for 20 seconds at an irradiation intensity of 500 mW/cm$^2$ by using a metal halide lamp. The coating solution was then heat treated for 30 minutes under the conditions that the temperature of the coat was 130° C. and a protective layer having a thickness of 5 μm was formed as a result.

Comparative Example 1

An electrophotographic photosensitive member was prepared as in Example 1 except that the protective layer-forming coating solution was prepared by using a compound represented by formula (10) below instead of Example Compound (C-1-1):

(10)

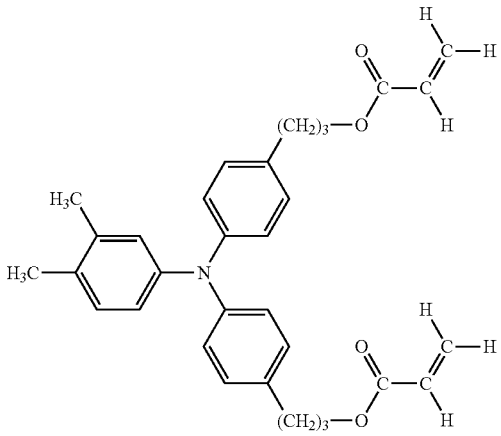

Comparative Example 2

An electrophotographic photosensitive member was prepared as in Example 1 except that the protective layer-forming coating solution was prepared by using a compound represented by formula (11) below instead of Example Compound (C-1-1):

(11)

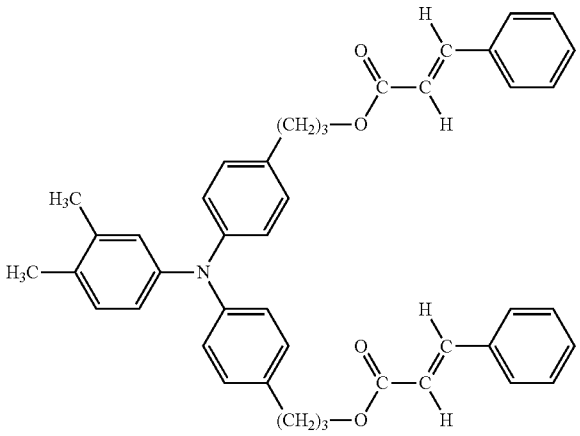

Comparative Example 3

An electrophotographic photosensitive member was prepared as in Example 1 except that the protective layer-forming coating solution was prepared by using a compound represented by formula (12) below instead of Example Compound (C-1-1):

(12)

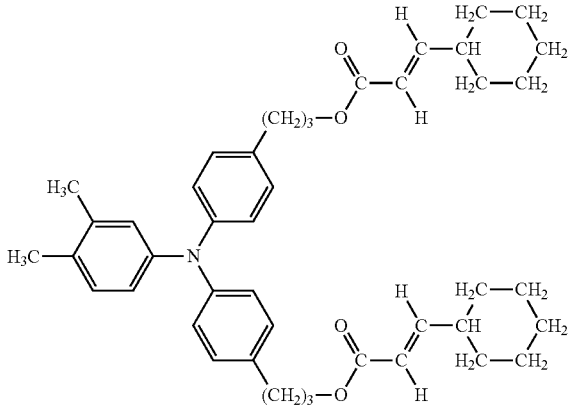

Comparative Example 4

An electrophotographic photosensitive member was prepared as in Example 1 except that the protective layer-forming coating solution was prepared by using a compound represented by formula (13) below instead of Example Compound (C-1-1):

(13)

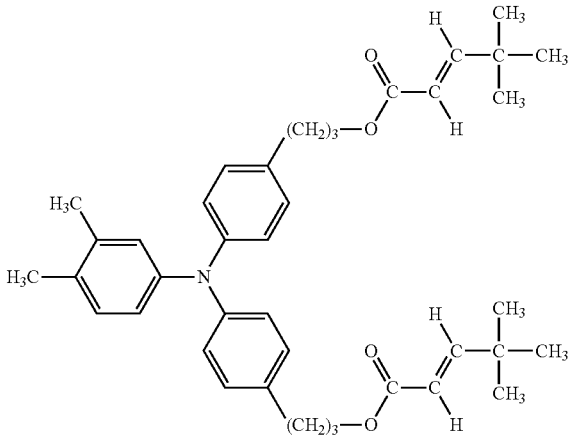

Comparative Example 5

An electrophotographic photosensitive member was prepared as in Example 1 except that the protective layer-forming coating solution was prepared by using a compound represented by formula (14) below instead of Example Compound (C-1-1):

(14)

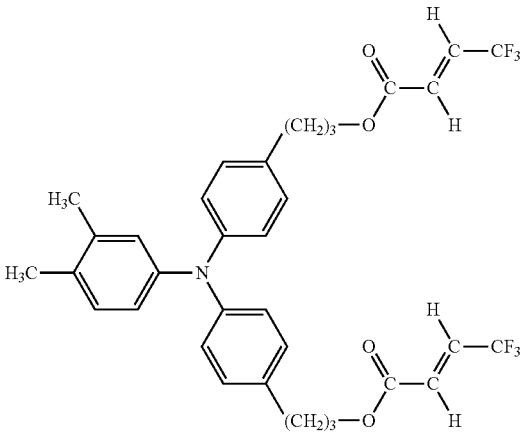

Comparative Example 6

An electrophotographic photosensitive member was prepared as in Example 1 except that the protective layer-forming coating solution was prepared by using a compound represented by formula (15) below instead of Example Compound (C-1-1):

(15)

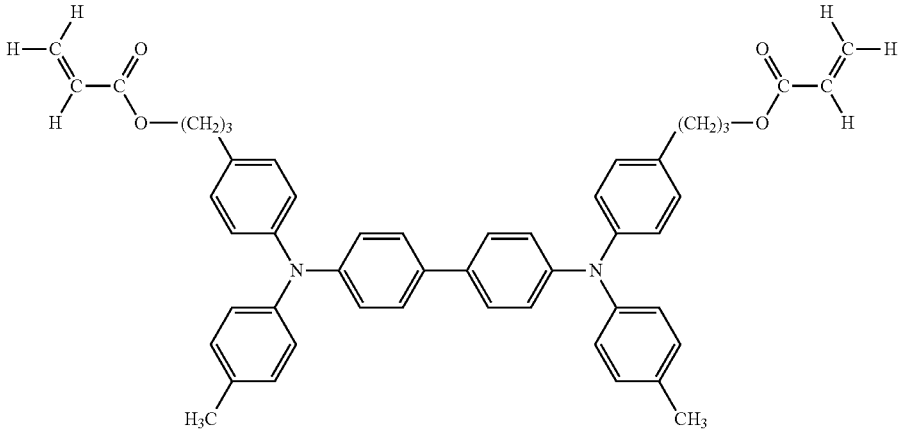

Comparative Example 7

An electrophotographic photosensitive member was prepared as in Example 1 except that the protective layer-forming coating solution was prepared by using a compound represented by formula (16) below instead of Example Compound (C-1-1):

(16)

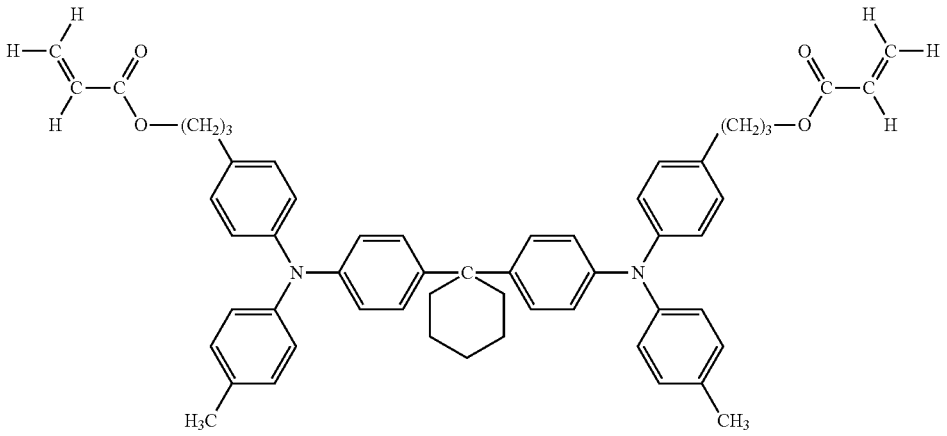

Comparative Example 8

An electrophotographic photosensitive member was prepared as in Example 1 except that the protective layer-forming coating solution was prepared by using a compound represented by formula (17) below instead of Example Compound (C-1-1):

(17)

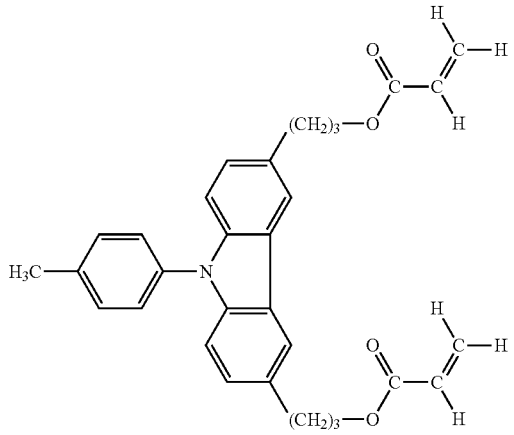

Comparative Example 9

An electrophotographic photosensitive member was prepared as in Example 1 except that the protective layer-forming coating solution was prepared by using a compound represented by formula (18) below instead of Example Compound (C-1-1):

(18)

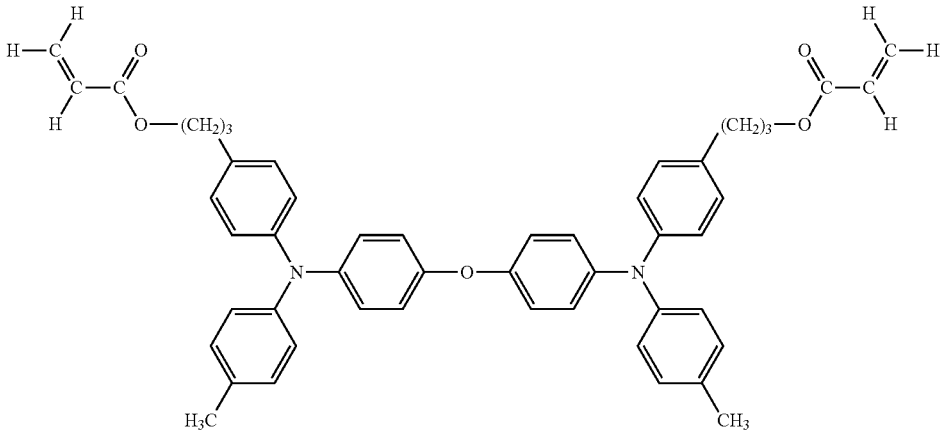

TABLE 1

| | Example Compound |
|---|---|
| Example 1 | (C-1-1) |
| Example 2 | (C-1-1) |
| Example 3 | (C-1-3) |
| Example 4 | (C-1-5) |
| Example 5 | (C-1-4) |
| Example 6 | (C-1-7) |
| Example 7 | (C-1-8) |
| Example 8 | (C-1-6) |
| Example 9 | (C-1-13) |
| Example 10 | (C-1-11) |
| Example 11 | (C-1-14) |
| Example 12 | (C-1-10) |
| Example 13 | (C-1-15) |
| Example 14 | (C-1-16) |
| Example 15 | (C-2-2) |
| Example 16 | (C-3-2) |
| Example 17 | (C-5-1) |

TABLE 1-continued

| | Example Compound |
|---|---|
| Example 18 | (C-4-2) |
| Example 19 | (C-1-1) |

Evaluation

Methods for evaluating the electrophotographic photosensitive members of Examples 1 to 19 and Comparative Examples 1 to 9 are as follows.

Evaluation of Images after being Left Standing Near Charging Roller for a Long Time A modified model of a copier GP-405 (trade name) produced by Canon Kabushiki Kaisha was used as an electrophotographic apparatus used as an evaluation apparatus 1. GP-405 (trade name) included a charging roller as a charging unit. The copier was modified so that power could be supplied to the charging roller from outside the copier.

A high voltage power supply control system (Model 615-3, produced by TREK INCORPORATED) was used as the power supply for supplying power to the charging roller from outside the copier. The system was tuned so that the discharge current amount was 300 μA under a constant voltage control and the conditions regarding the DC voltage applied to the charging roller and the exposure dose of the exposure unit were set so that the initial dark potential (Vd) of the electrophotographic photosensitive member was about −700 V and the initial light potential (Vl) was about −200 V.

Each of the electrophotographic photosensitive members prepared in Examples and Comparative Examples was loaded in a process cartridge. The process cartridge was loaded in the evaluation apparatus 1 and an image with an image ratio of 3% was output on 10,000 A4 size paper sheets in a portrait orientation at a temperature of 27° C. and a humidity of 75% RH. After 10,000 sheets were output, power supply to the evaluation apparatus 1 was stopped and the power was kept off for 2 weeks. After the two weeks, the evaluation apparatus 1 was turned on and a half tone image and a character image (letter E image, font type: Times, font size: 6 points) that included many letters of E were output on A4 size paper sheets in a portrait orientation.

The image was evaluated in terms of the effect of suppressing image defects and rated according to the following standards. A higher number indicates a higher effect. Samples rated Rank 6, 5, 4, or 3 were assumed to achieve the effect of suppressing image defects desirable in the present invention. Samples rated Rank 1 or 2 were assumed to not achieve the desirable effect of suppressing image defects.

Rank 6: No image defects (image deletion, for example) were observed in any of the halftone image and the letter-E image.

Rank 5: The density of the halftone image was slightly low but image defects were not observed in the letter-E image.

Rank 4: A white streak was observed in part of the halftone image but image defects were not observed in the letter-E image.

Rank 3: A white streak was observed in part of the halftone image and the density of the letter-E image was slightly low.

Rank 2: A white streak was observed in part of the halftone image and also in part of the letter-E image.

Rank 1: White streaks were observed in most part of the halftone image and in most part of the letter-E image.

Evaluation results are shown in Table 2.

Evaluation of Images after being Left Standing Near a Corona Charger for a Long Time A modified model of a copier (trade name: GP-405, produced by Canon Kabushiki Kaisha) was used as an electrophotographic apparatus used as an evaluation apparatus 2. The modification involved changing the charging roller of a process cartridge of the copier to a corona charger (corona charger for copier GP-55 (trade name) produced by Canon Kabushiki Kaisha) and modifying the copier so that the power could be supplied to the corona charger from outside the copier. Moreover, the drum cartridge of GP-405 was modified so that the corona charger could be installed therein and the charger of the electrophotographic copier GP-55 (produced by Canon Kabushiki Kaisha) was installed in the drum cartridge.

A high voltage power supply control system (Model 615-3, produced by TREK INCORPORATED) was used as the power supply for supplying power to the corona charger from outside the copier. The system was tuned so that the amount of current flowing in the corona wire of the corona charger was 500 μA. The voltage applied to the constant current control scorotron grid and the exposure dose of the exposure unit were set so that the initial dark potential (Vd) of the electrophotographic photosensitive member was about −700 V and the initial light potential (Vl) was about −200 V.

Each of the electrophotographic photosensitive members prepared in Examples and Comparative Examples was loaded in a process cartridge and the process cartridge was loaded into the evaluation apparatus 2. An image with an image ratio of 3% was output on 10,000 A4 size paper sheets in a portrait orientation at a temperature of 27° C. and a humidity of 75% RH. After 10,000 sheets were output, power supply to the evaluation apparatus was stopped and the power was kept off for 2 weeks. After the two weeks, the evaluation apparatus 2 was turned on and a half tone image and a character image (letter E image, font type: Times, font size: 6 points) that included many letters of E were output on A4 size paper sheets in a portrait orientation.

The image was evaluated in terms of the effect of suppressing image defects according to the same evaluation standards as above.

The evaluation results are shown in Table 2. Evaluation of surface potential of electrophotographic photosensitive member The electrophotographic photosensitive member which had been used in the evaluation apparatus 2 equipped with the corona charger and for which the image evaluation had been performed was installed in a drum tester CYNTHIA 59 produced by GEN-TECH INC., and the electrophotographic photosensitive member was rotated at a cycle speed of 1.0 sec/cycle. A scorotron corona charger was used to charge the surface of the electrophotographic photosensitive member. The primary current was set to 50 μA and the grid voltage was set so that the voltage applied to the surface of the electrophotographic photosensitive member was −700 V. A halogen lamp was used as a preexposure light source and the preexposure wavelength was selected by using a 676 nm interference filter so that the amount of the light was five times the amount of light at which the light potential was −200V. In measuring the surface potential of the electrophotographic photosensitive member, a potential measuring probe (model 6000B-8, produced by TREK JAPAN) was used. The surface potential (residual potential) 0.3 seconds after completion of the preexposure was measured.

The results are shown in Table 2.

TABLE 2

| | Evaluation of images after being left standing near charging roller for a long time: Rank | Evaluation of images after being left standing near corona charger for a long time: Rank | Residual potential [V] |
|---|---|---|---|
| Example 1 | 5 | 5 | 30 |
| Example 2 | 6 | 5 | 25 |
| Example 3 | 5 | 4 | 35 |
| Example 4 | 4 | 4 | 40 |
| Example 5 | 4 | 3 | 45 |
| Example 6 | 3 | 3 | 50 |
| Example 7 | 3 | 3 | 50 |
| Example 8 | 3 | 3 | 50 |
| Example 9 | 5 | 5 | 30 |
| Example 10 | 5 | 5 | 30 |
| Example 11 | 5 | 4 | 35 |
| Example 12 | 5 | 4 | 35 |
| Example 13 | 4 | 4 | 40 |
| Example 14 | 4 | 3 | 45 |
| Example 15 | 5 | 5 | 30 |
| Example 16 | 5 | 5 | 30 |
| Example 17 | 4 | 4 | 40 |
| Example 18 | 4 | 4 | 40 |
| Example 19 | 4 | 4 | 40 |
| Comparative Example 1 | 1 | 1 | 120 |
| Comparative Example 2 | 1 | 1 | 150 |
| Comparative Example 3 | 1 | 1 | 150 |
| Comparative Example 4 | 1 | 1 | 150 |
| Comparative Example 5 | 1 | 1 | 180 |
| Comparative Example 6 | 1 | 1 | 130 |
| Comparative Example 7 | 1 | 1 | 130 |
| Comparative Example 8 | 1 | 1 | 140 |
| Comparative Example 9 | 1 | 1 | 140 |

Immersion Test in Nitric Acid Aqueous Solution

First, 50 parts of concentrated nitric acid (69% aqueous solution, produced by Kishida Chemical Co., Ltd.) was dissolved in 50 parts of ion exchange water to prepare a 34.5% nitric acid aqueous solution.

Next, the protective layer-forming coating solutions prepared in Examples 1 to 19 and Comparative Examples 1 to 9 were each applied to a polyethylene terephthalate (PET) film by using a Meyer bar. The resulting coat was heat treated at 50° C. for 5 minutes. In a nitrogen atmosphere, the coat was irradiated with an electron beam for 1.6 seconds at an acceleration voltage of 70 kV and absorbed dose of 50000 Gy. Then the coat was heat treated in a nitrogen atmosphere for 25 seconds under such conditions that the temperature of the coat was 130° C. The oxygen concentration from the irradiation with an electron beam to the heat treatment for 25 seconds was 18 ppm. Then, the coat was heat treated for 12 minutes in air under such conditions that the temperature of the coat was 110° C. so as to form a film having a thickness of 5 μm. The films obtained as such were named films 1 to 19 and films C1 to C9 corresponding to Examples 1 to 19 and Comparative Examples 1 to 9.

Each film was immersed in a 34.5% nitric acid aqueous solution for 20 seconds and the color of the film was checked. If the film underwent coloration, it was assumed that the nitric acid aqueous solution penetrated inside the film and DA ion pairs were formed between the charge transport substance in the film and NOx (NO or $NO_2$). If the film is dense, it is difficult for the nitric acid aqueous solution to penetrate inside the film and the extent of coloration is small.

The results are shown in Table 3.

TABLE 3

| | | Coloration |
|---|---|---|
| Example 1 | Film 1 | No |
| Example 2 | Film 2 | No |
| Example 3 | Film 3 | No |
| Example 4 | Film 4 | No |
| Example 5 | Film 5 | No |
| Example 6 | Film 6 | No |
| Example 7 | Film 7 | No |
| Example 8 | Film 8 | No |
| Example 9 | Film 9 | No |
| Example 10 | Film 10 | No |
| Example 11 | Film 11 | No |
| Example 12 | Film 12 | No |
| Example 13 | Film 13 | No |
| Example 14 | Film 14 | No |
| Example 15 | Film 15 | No |
| Example 16 | Film 16 | No |
| Example 17 | Film 17 | No |
| Example 18 | Film 18 | No |
| Example 19 | Film 19 | No |
| Comparative Example 1 | Film C1 | Yes |
| Comparative Example 2 | Film C2 | Yes |
| Comparative Example 3 | Film C3 | Yes |
| Comparative Example 4 | Film C4 | Yes |
| Comparative Example 5 | Film C5 | Yes |
| Comparative Example 6 | Film C6 | Yes |
| Comparative Example 7 | Film C7 | Yes |
| Comparative Example 8 | Film C8 | Yes |
| Comparative Example 9 | Film C9 | Yes |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-253459 filed Nov. 19, 2012 and No. 2013-222955 filed Oct. 28, 2013, which are hereby incorporated by reference herein in their entirety.

What is claimed is:

1. An electrophotographic photosensitive member comprising:

a support, and a photosensitive layer formed on the support, wherein a surface layer of the electrophotographic photosensitive member comprises a polymerized product of a composition comprising a charge transporting compound with a polymerizable functional group represented by formula (1) below, (1)

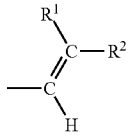

where, $R^1$ and $R^2$ each independently represent a hydrogen atom or a straight alkyl group, and at least one of $R^1$ and $R^2$ is the straight alkyl group, and wherein the charge transporting compound is a compound represented by formula (3) or (4) below, (3)

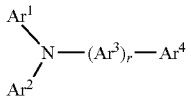

where, $Ar^1$, $Ar^2$, and $Ar^4$ each independently represent a monovalent group represented by formula (M1) below or a substituted or unsubstituted aryl group;

$Ar^3$ represents a divalent group represented by formula (M2) below or a substituted or unsubstituted arylene group; at least one of $Ar^1$ to $Ar^4$ represents a monovalent group represented by formula (M1) below or a divalent group represented by formula (M2) below; r is 0 or 1; and when none of $Ar^1$, $Ar^2$, and $Ar^4$ is a monovalent group represented by formula (M1) below, r is 1 and $Ar^3$ is a divalent group represented by formula (M2) below;

(4)

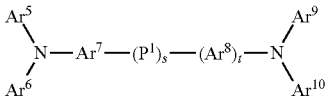

where, $A^5$, $Ar^6$, $Ar^9$, and $Ar^{10}$ each independently represent a monovalent group represented by formula (M1) below or a substituted or unsubstituted aryl group; $Ar^7$ and $Ar^8$ each independently represent a divalent group represented by formula (M2) below or a substituted or unsubstituted arylene group; at least one of $A^5$ to $Ar^8$ is a monovalent group represented by formula (M1) below or a divalent group represented by formula (M2) below;

$P^1$ represents an oxygen atom, a cycloalkylidene group, a divalent group having two phenylene groups bonded through an oxygen atom, or an ethylene group; s and t each independently represent 0 or 1; and when none of $A^5$, $Ar^6$, $Ar^9$, and $Ar^{10}$ is a monovalent group represented by formula (M1) below and $Ar^7$ is not a divalent group represented by formula (M2) below, t is 1 and $Ar^8$ is a divalent group represented by formula (M2) below;

(M1)

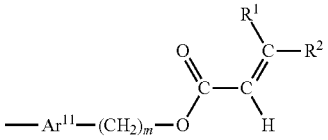

where, $R^1$ and $R^2$ are the same as $R^1$ and $R^2$ in formula (1), $Ar^{11}$ represents a substituted or unsubstituted arylene group, and m represents an integer of 1 or more:

(M2)

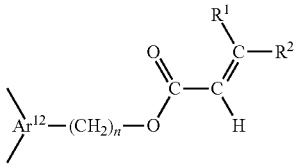

where, $R^1$ and $R^2$ are the same as $R^1$ and $R^2$ in formula (1), $Ar^{12}$ represents a substituted or unsubstituted trivalent aromatic hydrocarbon group, and n represents an integer of 1 or more.

2. The electrophotographic photosensitive member according to claim 1, wherein the charge transporting compound is a charge transporting compound with a polymerizable functional group represented by formula (2) below, (2)

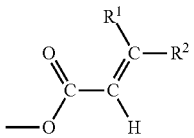

where, $R^1$ and $R^2$ are the same as $R^1$ and $R^2$ in formula (1).

3. The electrophotographic photosensitive member according to claim 2, wherein $R^1$ and $R^2$ each independently represent a hydrogen atom, a methyl group, an ethyl group, or a n-propyl group, and at least one of $R^1$ and $R^2$ is the methyl group, the ethyl group, or the n-propyl group.

4. The electrophotographic photosensitive member according to claim 3, wherein $R^1$ is a hydrogen atom and $R^2$ is a methyl group, an ethyl group, or a n-propyl group.

5. The electrophotographic photosensitive member according to claim 4, wherein $R^1$ is a hydrogen atom and $R^2$ is a methyl group.

6. The electrophotographic photosensitive member according to claim 1, wherein the charge transporting compound is a compound represented by formula (3) and at least two of $Ar^1$ to $Ar^4$ are each a monovalent group represented by formula (M1) or a divalent group represented by formula (M2).

7. The electrophotographic photosensitive member according to claim 1, wherein the charge transporting compound is a compound represented by formula (4) and at least two of $Ar^5$ to $Ar^{10}$ are each a monovalent group represented by formula (M1) or a divalent group represented by formula (M2).

8. The electrophotographic photosensitive member according to claim 1, wherein the composition further comprises at least one compound selected from the group consisting of a compound represented by formula (B) below and a compound represented by formula (C) below, (B)

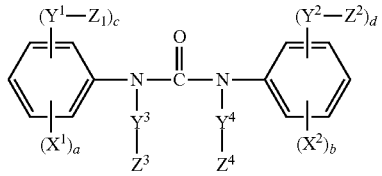

where, $X^1$ and $X^2$ each independently represent a methyl group, an ethyl group, a n-propyl group, a methoxymethyl group, a trifluoromethyl group, a trichloromethyl group, a methoxy group, an ethoxy group, a propoxy group, a methoxymethoxy group, a trifluoromethoxy group, a trichloromethoxy group, a dimethylamino group, or a fluorine atom; $Y^1$ and $Y^2$ each independently represent an alkylene group; $Z^1$ to $Z^4$ each independently represent a hydrogen atom, an acryloyloxy group, a methacryloyloxy group, a monovalent group represented by formula (5) below, or a monovalent group represented by formula (6) below; at least one of $Z^1$ to $Z^4$ represents an acryloyloxy group, a methacryloyloxy group, a monovalent group represented by formula (5) below, or a monovalent group represented by formula (6) below; a and b each independently represent an integer of 0 or more and 5 or less; and c and d each independently represent 0 or 1, (C)

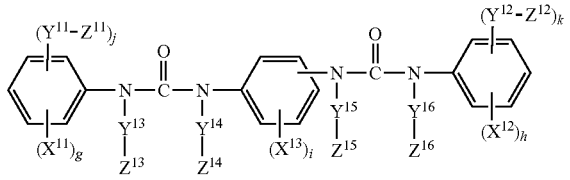

where, $X^{11}$ to $X^{13}$ each independently represent a methyl group, an ethyl group, a n-propyl group, a methoxymethyl group, a trifluoromethyl group, a trichloromethyl group, a methoxy group, an ethoxy group, a propoxy group, a methoxymethoxy group, a trifluoromethoxy group, a trichloromethoxy group, a dimethylamino group, or a fluorine atom; $Y^{11}$ to $Y^{16}$ each independently represent an alkylene group; $Z^{11}$ to $Z^{16}$ each independently represent a hydrogen atom, an acryloyloxy group, a methacryloyloxy group, a monovalent group represented by formula (5) below, or a monovalent group represented by formula (6) below; at least one of $Z^{11}$ to $Z^{16}$ is an acryloyloxy group, a methacryloyloxy group, a monovalent group represented by formula (5) below, or a monovalent group represented by formula (6) below; g and h each independently represent an integer of 0 or more and 5 or less; i represents an integer of 0 or more and 4 or less; and j and k each independently represent 0 or 1;

(5)

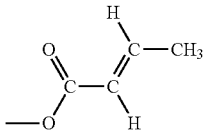

(6)

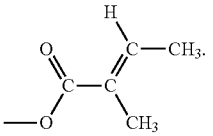

9. A method for producing the electrophotographic photosensitive member according to claim 1, the method comprising:

forming a coat by using a surface layer-forming coating solution comprising a composition comprising the charge transporting compound; and forming a surface layer by polymerizing the composition contained in the coat.

10. The method according to claim 9, wherein the composition is polymerized by irradiating the coat with an electron beam.

11. A process cartridge detachably attachable to a main body of an electrophotographic apparatus, wherein the process cartridge integrally supports: the electrophotographic photosensitive member according to claim 1, and at least one unit selected from the group consisting of a charging unit, a development unit, a transfer unit, and a cleaning unit.

12. An electrophotographic apparatus comprising the electrophotographic photosensitive member according to claim 1, a charging unit, an exposure unit, a development unit, and a transfer unit.

* * * * *